US010875067B2

(12) United States Patent
Gaensbauer et al.

(10) Patent No.: US 10,875,067 B2
(45) Date of Patent: Dec. 29, 2020

(54) PRE-HEATING AND THERMAL CONTROL OF WORK ROLLS IN METAL ROLLING PROCESSES AND CONTROL SYSTEMS THEREOF

(71) Applicant: Novelis Inc., Atlanta, GA (US)

(72) Inventors: David Anthony Gaensbauer, Atlanta, GA (US); Francisco Carvalho, Guaratinguetá (BR); Eduardo Minniti, Pindamonhangaba (BR); Tiago Moraes, Taubaté (BR); Carlos Eboli, Kennesaw, GA (US)

(73) Assignee: NOVELIS INC., Atlanta, GA (US)

( * ) Notice: Subject to any disclaimer, the term of this patent is extended or adjusted under 35 U.S.C. 154(b) by 625 days.

(21) Appl. No.: 15/271,265

(22) Filed: Sep. 21, 2016

(65) Prior Publication Data

US 2017/0080467 A1 Mar. 23, 2017

Related U.S. Application Data

(60) Provisional application No. 62/221,491, filed on Sep. 21, 2015.

(51) Int. Cl.
*B21B 37/74* (2006.01)
*B21B 1/22* (2006.01)
(Continued)

(52) U.S. Cl.
CPC ..... *B21B 37/74* (2013.01); *B21B 1/22* (2013.01); *B21B 27/106* (2013.01); *B21B 37/16* (2013.01);
(Continued)

(58) Field of Classification Search
CPC ..... B21B 37/32; B21B 37/74; B21B 27/106; B21B 27/10; B21B 27/06; B21B 38/006
See application file for complete search history.

(56) References Cited

U.S. PATENT DOCUMENTS 7,181,822 B2 * 2/2007 Ondrovic ..... B21B 37/32 164/476
2007/0186609 A1 8/2007 Richter et al.
(Continued)

FOREIGN PATENT DOCUMENTS

CN 2278545 Y 4/1998
CN 202845443 U 4/2013
(Continued)

OTHER PUBLICATIONS

International Patent Application No. PCT/US2016/052753, International Search Report and Written Opinion dated Jan. 9, 2017, 12 pages.
(Continued)

*Primary Examiner* — Debra M Sullivan
(74) *Attorney, Agent, or Firm* — Kilpatrick Townsend & Stockton LLP

(57) ABSTRACT

Systems and methods for using full-width hot sprays to pre-heat rolling mills prior to processing of metal sheet or plate are described herein. The hot sprays may be individually controlled. Using hot sprays can allow the rolling mill to reach operating temperature and achieve a desired thermal crown so that metal sheet or plate may be processed immediately within tolerances for flatness and gauge accuracy. Pre-heating of rolling mills can eliminate the need of the rolling mill to operate in a transitional period of work roll heating and can increase efficiency by eliminating or reducing scrap material and mill downtime. Hot sprays may also be incorporated with existing coolant systems to provide thermal control systems for rolling mills with bi-directional temperature controls.

33 Claims, 8 Drawing Sheets

(51) Int. Cl.

| | |
|---|---|
| ***B21B 37/16*** | (2006.01) |
| ***B21B 27/10*** | (2006.01) |
| ***B21B 37/32*** | (2006.01) |
| *B21B 38/04* | (2006.01) |
| *B21B 38/00* | (2006.01) |
| *B21B 38/02* | (2006.01) |

(52) U.S. Cl.

CPC ..... *B21B 37/32* (2013.01); *B21B 38/006* (2013.01); *B21B 38/02* (2013.01); *B21B 38/04* (2013.01); *B21B 2001/225* (2013.01); *B21B 2027/103* (2013.01)

(56) References Cited

U.S. PATENT DOCUMENTS

| | | | | |
|---|---|---|---|---|
| 2010/0064748 | A1 | 3/2010 | Ootsuka et al. | |
| 2011/0005285 | A1 | 1/2011 | Otsuka et al. | |
| 2011/0308288 | A1* | 12/2011 | McRae ..... | B21B 3/00 72/11.1 |

FOREIGN PATENT DOCUMENTS

| | | | |
|---|---|---|---|
| CN | 202943088 | U | 5/2013 |
| GB | 1316786 | A | 5/1973 |
| JP | S49-9031 | B1 | 3/1974 |
| JP | S49-43464 | B1 | 11/1974 |
| JP | S58-128208 | A | 7/1983 |
| JP | H02-112811 | A | 4/1990 |
| JP | H06-170420 | A | 6/1994 |
| JP | 2001001017 | A | 1/2001 |
| JP | 3622743 | B2 | 2/2005 |
| JP | 2014-24111 | A | 2/2014 |
| KR | 20100111730 | | 10/2010 |
| RU | 2523177 | C2 | 7/2014 |
| SU | 994068 | | 2/1983 |
| WO | 2011025139 | A2 | 3/2011 |
| WO | 2011126139 | A1 | 10/2011 |

OTHER PUBLICATIONS

International Patent Application No. PCT/US2016/052753, International Preliminary Report on Patentability dated Apr. 5, 2018, 9 pages.

Office Action issued in Canadian Application No. 2,998,379 dated Dec. 27, 2018 (7 pages).

Office Action issued in Chinese Application No. 201680054557.0 dated Nov. 1, 2018 along with an English translation (24 pages).

Office Action issued in Russian Application No. 2018110545 dated Dec. 28, 2018 along with an English translation (13 pages).

Office Action issued in Japanese Patent Application No. 2018-514845 dated Mar. 5, 2019, along with an English translation (8 pages).

Office Action issued in Chinese Patent Application No. 201680054557.0 dated Jun. 3, 2019, along with an English translation (19 pages).

Office Action issued in Russian Patent Application No. 2018110545 dated May 20, 2019, along with an English translation (13 pages).

Communication pursuant to Article 94(3) EPC issued in European Patent Application No. 16774773.2 dated Oct. 9, 2019, 5 pages.

Office Action issued in Korean Patent Application No. 10-2018-7010192 dated Aug. 13, 2019, along with an English translation, 15 pages.

Indian Patent Application No. 201817008964 , "First Examination Report", dated Feb. 20, 2020, 6 pages.

Chinese Patent Application No. CN201680054557.0 , "Office Action", dated Jan. 7, 2020, 27 pages.

Korean Patent Application No. KR10-2018-7010192 , "Office Action", dated Jan. 29, 2020, 4 pages.

Application No. BR1120180053686 , Office Action, dated Jul. 7, 2020, 5 pages.

* cited by examiner

PRE-HEATING AND THERMAL CONTROL OF WORK ROLLS IN METAL ROLLING PROCESSES AND CONTROL SYSTEMS THEREOF

CROSS-REFERENCE TO RELATED APPLICATION

This application claims the benefit of U.S. Provisional Application No. 62/221,491, filed Sep. 21, 2015, which is incorporated herein by reference in its entirety.

FIELD OF THE INVENTION

The present disclosure generally relates to metal rolling mills. More specifically, the present disclosure relates to the use of hot sprays to pre-heat and thermally stabilize metal working rolls and associated control systems.

BACKGROUND

Rolling mills are used to process metal stock into metal sheet or plate by passing it between large rollers that apply pressure and deform the metal stock. By passing the metal stock through successive series of rollers, relatively thick metal stock may be gradually reduced into relatively thinner metal stock, eventually resulting in metal sheet or plate.

During the rolling process, maintaining a uniform gauge (e.g., thickness) across the surface of the metal sheet or plate may be challenging. For example, the metal sheet or plate may develop waviness or ripples as it passes through the work rollers and they reduce or thin its gauge. Waviness may be due to, among other things, deflection in the work rolls as the metal stock is deformed during processing, deflection of the work rolls from the use of backup rolls, and bending or deflection of the work rolls from the use of hydraulic actuators to apply pressure to the work rolls.

To compensate for and reduce irregularities across the face of a metal sheet or plate during production, work rolls may have a small amount of camber or crown to improve gauge consistency and flatness. The crown or camber, which is a slight bulge or depression across the face of the work roll, can account for the deflection of the work roll during use. The crown or camber may counteract the deflection of the work rolls such that the net shape of the work roll as applied to the metal stock is very nearly a perfect cylinder. The resulting metal sheet or plate will have improved flatness and consistency of gauge across its width.

Crown or camber may be static, such as a slight barrel shape ground or formed into the work roll, or dynamic, as with crown or camber due to the application of backup rolls, pressure, or the expansion and contraction of the work roll due to changes in temperature. Typically, the net shape of the work rolls after static and/or dynamic crown or camber is applied should be such that the work rolls will produce the flattest, most uniform metal sheet or plate possible.

Thermal camber, which is camber or crown of the work rolls due to temperature variations, is generally controlled by applying cooling sprays across the work rolls and heating sprays at the edge of the work rolls to try to stabilize work roll temperature, and consequently work roll thermal camber, during production. However, rolling mill startup and changeovers of material during the rolling process produce transitional periods where the work rolls may not have achieved steady-state temperatures that stabilize work roll thermal crowns. To achieve acceptable levels of flatness and gauge control, rolling mills will often run test or startup material to allow the work rolls to heat up to operating temperature. These startup rolls must then be scrapped or further processed because they do not achieve production specifications. The use of startup material to heat and thermally stabilize work rolls leads to wasted time and material, and increased production costs.

SUMMARY

Aspects of the present disclosure relate to the use of work face heating sprays applied to work rolls in metal rolling mills. The work face heating sprays are used to pre-heat the work rolls to, or close to, operating temperature. The heated liquid medium, or heatant, may be sprayed across the face of the work roll to build up and stabilize thermal crown quickly without the use of startup material that may need to be scrapped or otherwise disposed of. The resulting rolling startup process can involve less downtime, reduce waste, and can provide improved process control and product quality. The work face heating sprays, according to certain examples of the present disclosure, may be applied uniformly across the face of the work rolls, or they may be applied at different rates to different zones of the work roll to provide additional control and adjustability of work roll thermal crown. The work face heating sprays may be used independently, or in conjunction with edge-heating sprays and coolant, to provide thermal stabilization and improved product quality after initial startup, and normalize work roll thermal crown during changes in material, rolling parameters, or process conditions.

The work face heating sprays may be applied or controlled manually or by an active or passive control system to vary the amount of pre-heating applied to the work rolls. In some examples, the active or passive control system may include thermal models or sensors for measurement and feedback control. For example, the control system may include models or sensors for direct or indirect sensing of work roll temperature, work roll camber or crown, metal sheet gauge, metal sheet flatness, heatant temperature, coolant temperature, and/or sensors to quantify material quality, such as flatness, after rolling.

BRIEF DESCRIPTION OF THE DRAWINGS

Illustrative examples of the present disclosure are described in detail below with reference to the following drawing figures.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Certain aspects and features of the present disclosure relate to the use of a work face heating spray and optional control system in combination with a rolling mill for producing a metal sheet or plate. A work face heating spray allows for pre-heating of the work rolls of a rolling mill to fully (or more fully) develop a thermal crown on a surface of the work rolls prior to processing metal stock using the work rolls. Pre-heating the work rolls prior to metal processing allows the initial metal stock to be processed into metal sheet or plate without transient thermal behavior of the work rolls. As such, the work roll crown or camber, including both dynamic and static crown, may be fully (or more fully) developed to help the initial metal stock achieve a desired flatness quality. Application of a work face heating spray to the work rolls of a rolling mill prior to initial metal processing allows for faster start-up, reduced time between transitions in metal or rolling parameters, and reduction or elimination of scrap metal that does not meet desired flatness and quality specifications. Furthermore, the combination of full-width heating sprays and cooling sprays allows for a broader range of control over work roll temperature than is possible with cooling sprays alone.

Figure 1:
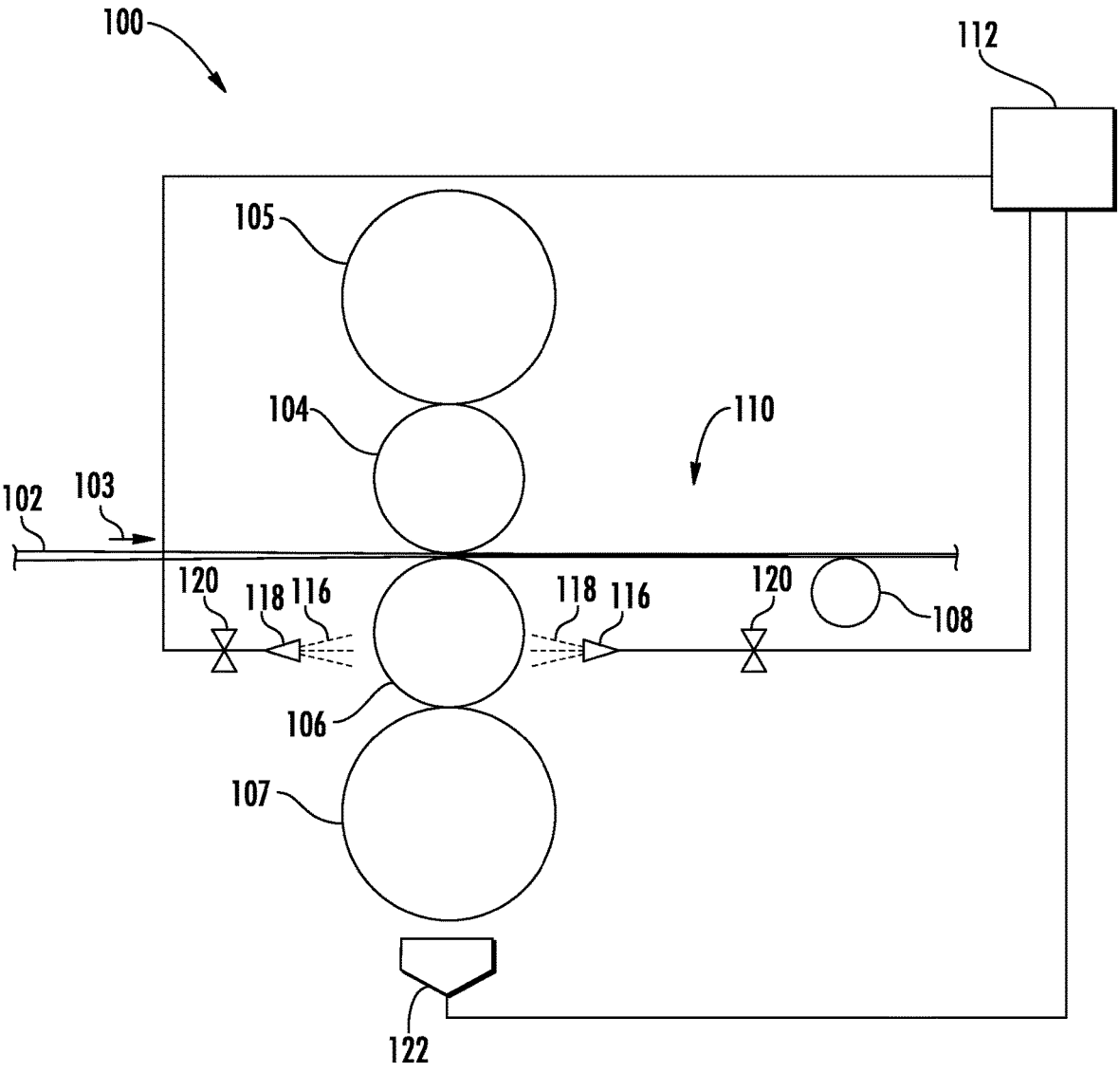
FIG. 1 is a schematic side view of a rolling mill, along with a work face heating spray system.
Figure 2:
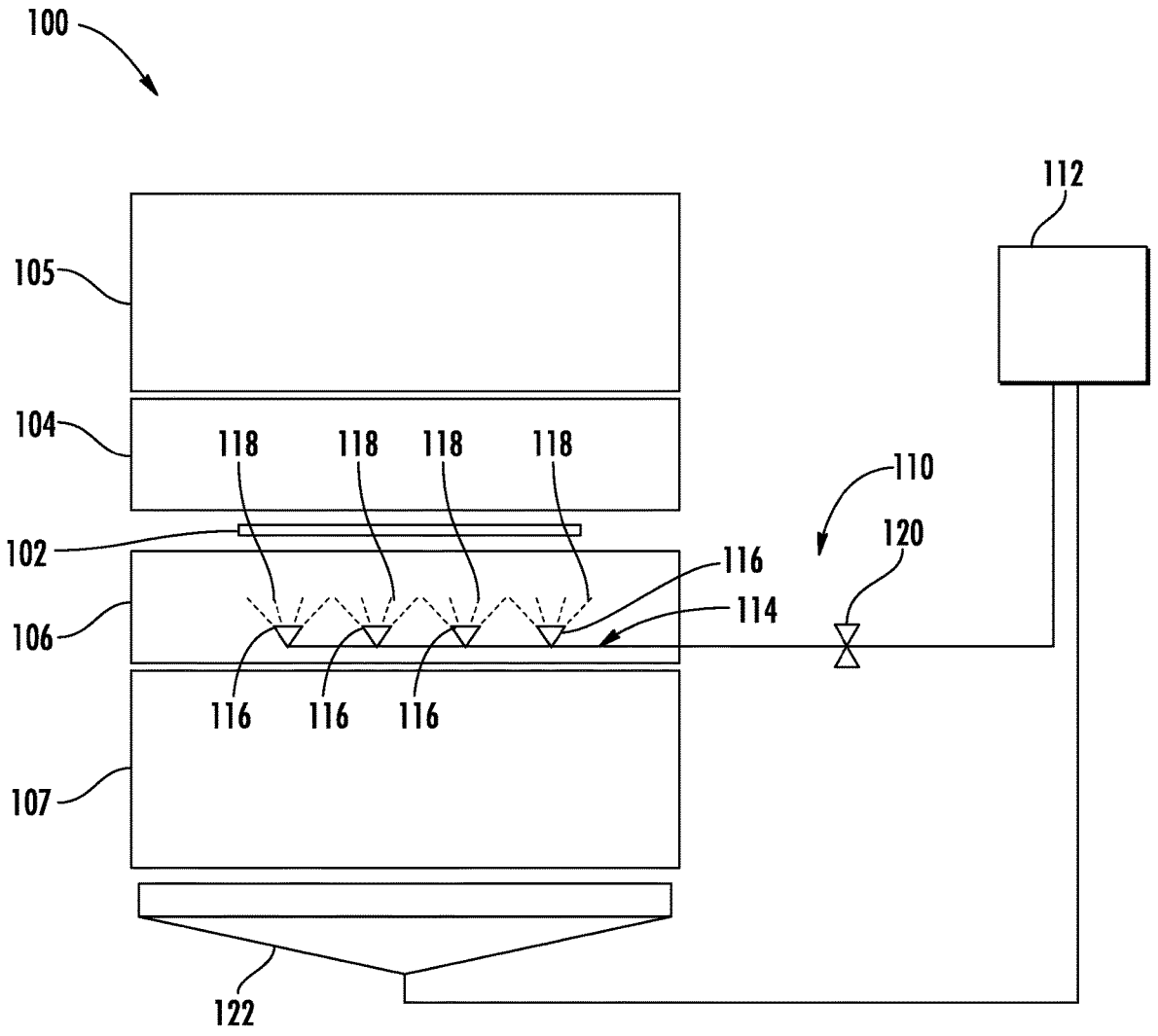
FIG. 2 is a schematic end view of the rolling mill and the work face heating spray system of FIG. 1.

FIGS. 1 and 2 are schematic side and end views of an exemplary rolling mill 100 with a work face heating spray system 110. The rolling mill 100 includes an upper work roll 104 with an upper backup roll 105 and a lower work roll 106 with a lower backup roll 107. A metal sheet or plate 102 can be passed between the upper work roll 104 and the lower work roll 106 to reduce gauge thickness of the metal sheet or plate 102. In some examples, the rolling mill 100 may include a flatness measurement roll 108 that measures the metal sheet or plate 102 after it passes between the upper work roll 104 and the lower work roll 106 to determine whether the metal sheet or plate 102 has achieved uniformity in gauge across its width. In the example depicted in FIG. 1, the rolling mill 100 is shown as processing the metal sheet or plate 102 that enters the rolling mill 100 from the left and progresses towards the right of FIG. 1 as shown by motion arrow 103.

Still referring to FIGS. 1 and 2, the rolling mill 100 includes a spray system 110 that includes a heatant reservoir 112, which contains a volume of a liquid heating medium or heatant. The heatant may be oil, water, or any suitable liquid, which can be chosen for its working temperature range and/or specific heat and/or heat transfer properties. In some examples, the heatant can be a fluid kept at approximately 95 degrees Celsius. The heatant can be delivered from the heatant reservoir 112 to a heatant spray manifold 114 (FIG. 2) that distributes the heatant to heatant spray nozzles 116 that are positioned across width of the rolls.

The heatant spray nozzles 116 convert the heatant into a heatant spray 118 that is applied to the lower work roll 106 during startup and prior to the intake of metal sheet or plate 102. Alternatively, the heatant spray 118 may be applied to the upper work roll 104 or both the upper work roll 104 and the lower work roll 106. In some examples, a heatant control valve 120 and heatant recovery catch 122 may be included in the spray system 110. In such examples, the heatant control valve 120 may control the flow of the heatant to the upper work roll 104 and/or the lower work roll 106, while the heatant recovery catch 122 can be positioned near the heatant spray nozzles 116 or near the upper work roll 104 and/or the lower work roll 106 to collect an amount of the heatant and return the collected amount of the heatant to the heatant reservoir 112.

The placement of the heatant spray nozzles 116 may vary depending on the particular application. As shown in FIGS. 1 and 2, the heatant spray nozzles 116 may be positioned on the exit side of the upper work roll 104 and/or the lower work roll 106 or on the intake side of the upper work roll 104 and/or the lower work roll 106. The heatant spray nozzles may also be located above, below, or to the sides of the upper work roll 104 and/or the lower work roll 106. In some cases, the heatant spray manifold 114 may be configured to position the heatant spray nozzles 116 such that the heatant spray 118 is applied to the entire face or substantially the entire face (e.g., approximately ninety percent or more) of the upper work roll 104 and/or the lower work roll 106. However, it is not necessary in all applications that the heatant spray 118 provides coverage or be applied to the entire face of the upper work roll 104 and/or the lower work roll 106. In certain examples, the heatant sprays 118 may provide coverage only for a portion of the upper work roll 104 and/or the lower work roll 106 that contacts the metal sheet or plate 102. Moreover, in some examples, instead of multiple heatant spray nozzles 116, the spray system 110 may include a single, large distribution port or nozzle configured to apply a heatant spray 118 or heatant streams to the upper work roll 104 and/or the lower work roll 106. Once the upper work roll 104 and/or the lower work roll 106 has achieved proper operating temperature, the metal sheet or plate 102 may enter the rolling mill 100 for processing. The spray system 110 may continue operation, be turned off, or operate at a reduced level to continue to provide heating and temperature stabilization to the rolling mill 100 (e.g., continue to apply the heatant spray 118 to the upper work roll 104 and/or the lower work roll 106).

Figure 3:
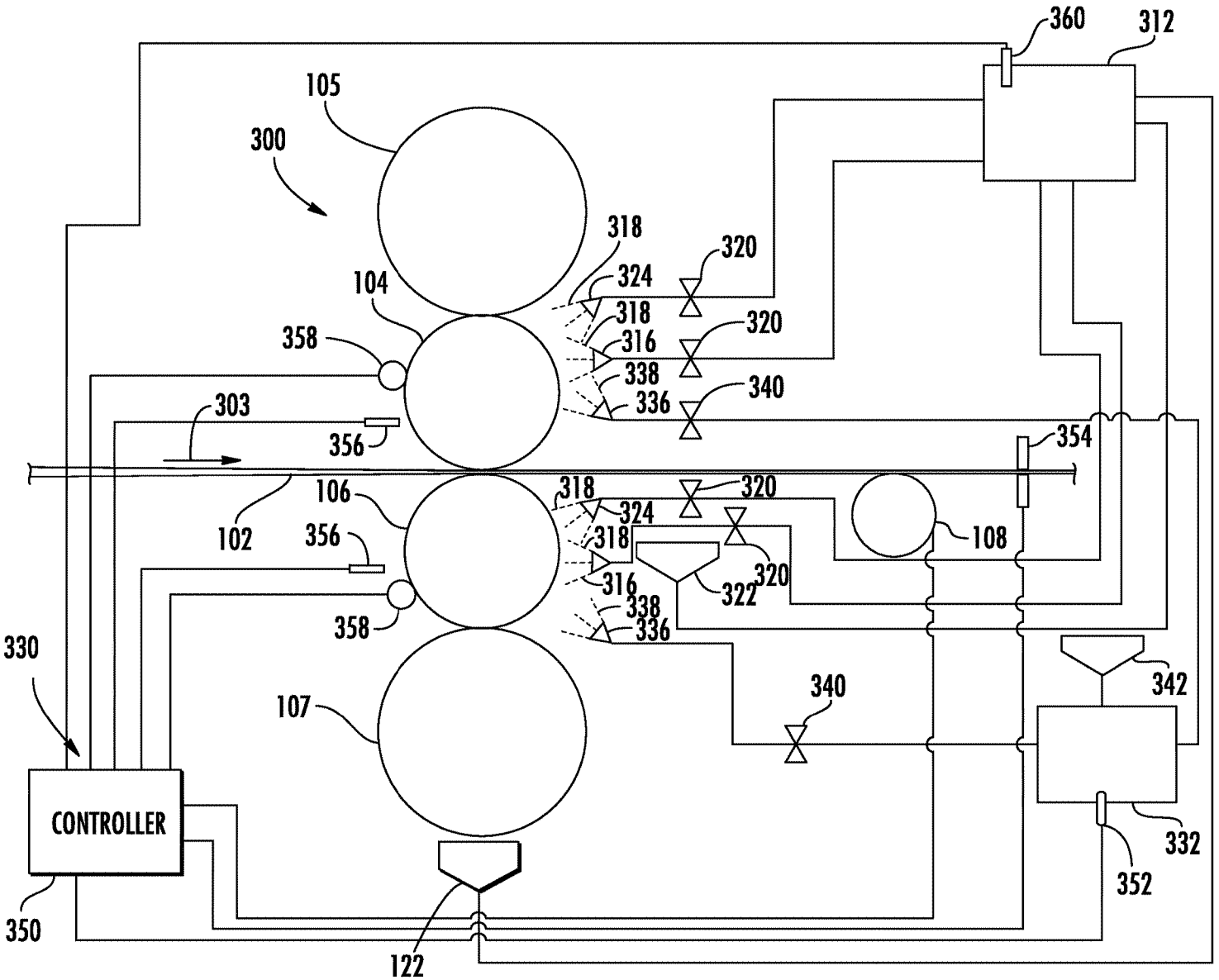
FIG. 3 is a schematic side view of a rolling mill with a thermal control system.
Figure 4:
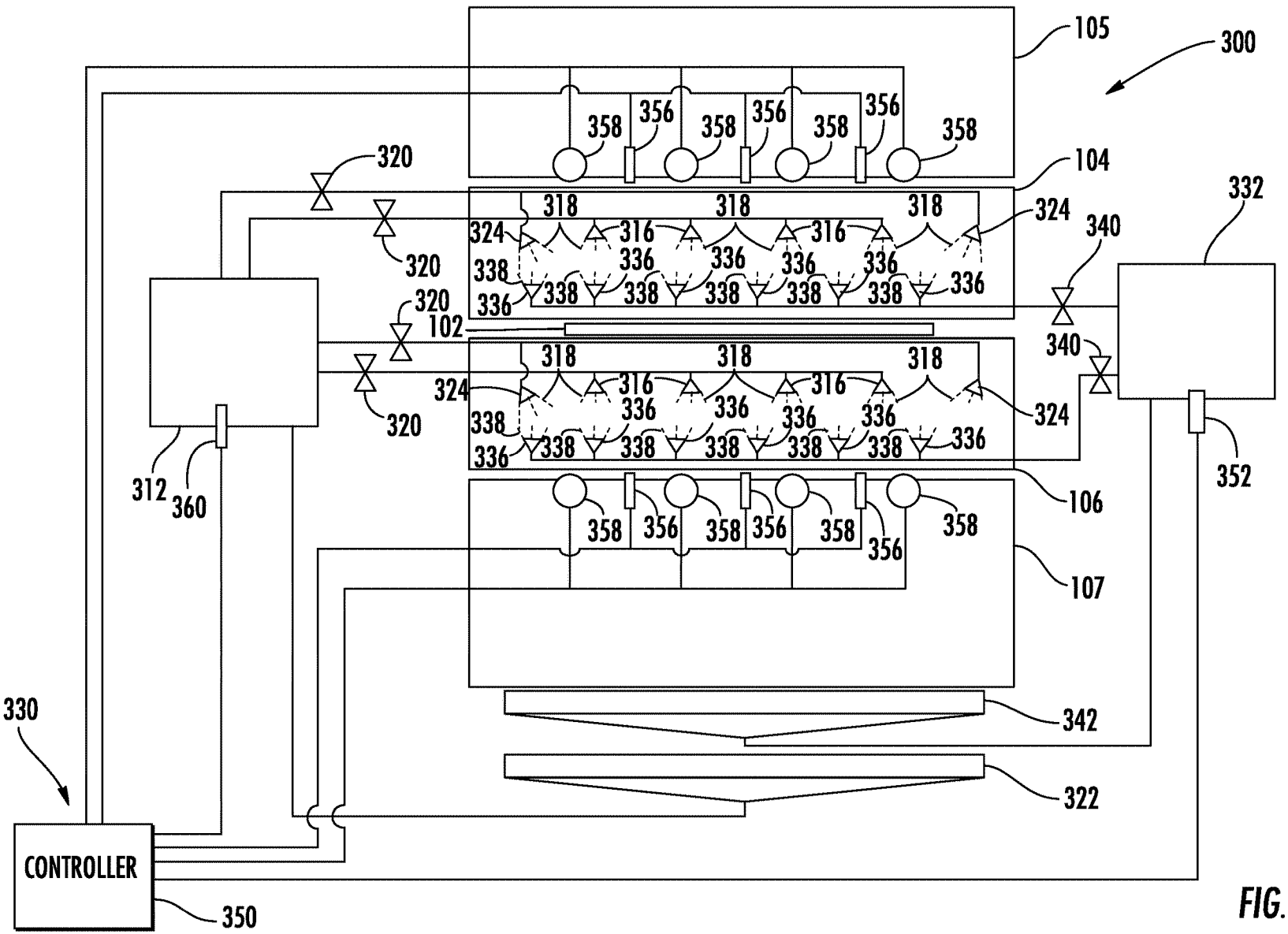
FIG. 4 is a schematic end view of the rolling mill with thermal control system of FIG. 3.

FIGS. 3 and 4 are schematic side and end views of an exemplary rolling mill 300 with thermal control system 330. The rolling mill 300 includes an upper work roll 104 with an upper backup roll 105 and a lower work roll 106 with a lower backup roll 107, as described above with reference to FIGS. 1 and 2. In the examples depicted in FIGS. 3 and 4, the rolling mill 300 is shown as processing a metal sheet or plate 102 that enters the rolling mill 300 from the left and progresses towards the right as shown by motion arrow 303 of FIG. 3.

The thermal control system 330 is incorporated into the rolling mill 300 to provide thermal control of the upper work rolls 104 and/or lower work rolls 106 during startup and continuous operation of the rolling mill 300. A heatant reservoir 312 supplies a liquid heatant via one or more optional heatant control valves 320 to heatant spray nozzles 316 and heatant side spray nozzles 324. In some examples, the liquid heatant can be a fluid kept at approximately 95 degrees Celsius. The heatant spray nozzles 316 and heatant side spray nozzles 324 direct a heatant spray 318, which includes the liquid heatant, towards the faces of the upper work rolls 104 and/or lower work rolls 106. In some examples, the heatant spray nozzles 316 may direct the heatant spray 318 to cover the full width or substantially the full width (e.g., approximately ninety percent or more) of the upper work rolls 104 and/or lower work rolls 106, which can eliminate the need for separate heatant side spray nozzles 324. However, individual control of the heatant spray nozzles 316 and/or heatant side spray nozzles 324 allows for adjustment to the spray pattern and coverage regardless of whether separate heatant side spray nozzles 324 are included in the thermal control system 330. In some examples, the thermal control system 330 can include a heatant recovery catch 322 and the heatant recovery catch 322 can recover heatant after it has been cast off or otherwise removed from the upper work rolls 104 and/or the lower work rolls 106 and return the heatant to the heatant reservoir 312.

To provide bi-directional thermal control to the rolling mill 300 and the upper work rolls 104 and/or the lower work rolls 106, a cooling system may also be incorporated into the thermal control system 330. For example, a coolant reservoir 332 can supply a coolant through coolant control valves 340 to coolant spray nozzles 336. The coolant spray nozzles 336 can direct a coolant spray 338 that includes the coolant to the faces of the upper work rolls 104 and/or the lower work rolls 106. Coolant that has been cast off or otherwise removed from the upper work rolls 104 and/or the lower work rolls 106 and the rolling mill 300 may be collected in a coolant recovery catch 342 that can return the collected coolant to the coolant reservoir 332.

While the thermal control system 330 of FIGS. 3 and 4 may be manually controlled, a control system may be included to provide automatic thermal management to the rolling mill 300. For example, the thermal control system 330 can include a controller 350 that can receive data about process and rolling mill conditions from a variety of sensors placed throughout the control system. The sensors, which may be any type of sensor that provides accurate measurements under the particular conditions and requirements of any specific application, may feed information into the controller 350 to be used in a thermal model or as part of a feedback loop control system. As an example, a heatant temperature sensor 360 and a coolant temperature sensor 352 may provide information to the controller 350 to calculate current system conditions and adjust the application of heatant or coolant to the upper work rolls 104 and/or the lower work rolls 106 accordingly.

For example, if the controller 350 receives data indicating a high coolant temperature from coolant temperature sensor 352, the controller 350 may increase coolant flow to compensate for the reduced cooling capacity of the coolant. The controller 350 may also receive data from a flatness measurement roll 108 and/or a metal sheet or plate gauge sensor 354. The flatness measurement roll 108 and the gauge sensor 354 may provide the controller 350 with data indicating a real-time measurement of the properties of the metal sheet or plate 102 as it leaves the rolling mill 300. The controller 350 may then adjust one or more parameters of the thermal control system 330 based on the data received from the flatness measurement roll 108 and/or the metal sheet or the plate gauge sensor 354. In some examples, the controller 350 may also receive data from one or more roll temperature sensors 356 or roll crown sensors 358. The roll temperature sensors 356 and the roll crown sensors 358 may transmit data about the upper work rolls 104 and/or the lower work rolls 106 and the current conditions under which they are operating to the controller 350. The controller 350 may then adjust one or more parameters of the thermal control system 330 based on data received from the roll temperature sensors 356 and/or the roll crown sensors 358. In some examples, the controller 350 may use both the output conditions of the metal sheet or plate 102 and the operating conditions of the rolling mill 300 to further adjust the thermal control system 330.

Still referring to FIGS. 3 and 4, the coolant spray nozzles 336, the heatant spray nozzles 316, and/or the heatant side spray nozzles 324 may be arranged in any manner to create distinct heating and cooling zones across the face of the upper work rolls 104 and/or the lower work rolls 106. Distinct heating and cooling zones, which may be used in combination with multiple roll temperature sensors 356, roll crown sensors 358, and/or gauge sensors 354 to create multiple control zones, can allow for additional flexibility in controlling the conditions of the rolling mill 300.

Furthermore, creating or controlling different heating and/or cooling zones across the upper work rolls 104 and/or the lower work rolls 106 allows for the creation of different thermal curves or patterns across the upper work rolls 104 and/or the lower work rolls 106, which may provide greater control and flexibility to the rolling mill 300 to process a wider variety of materials and metal sheet or plate 102 geometries. In some examples, use of a single control zone to provide thermal stability to the upper work rolls 104 and/or the lower work rolls 106 may be sufficient for the particular quality and flatness targets of a rolling mill and its intended application. More detail on how the individually controlled zones may be achieved is provided below. In some examples, the thermal control system 330 may also be configured in any manner such that the heatant spray nozzles 316, the heatant side spray nozzles 324, and/or the coolant spray nozzles 336 can be mounted or arranged so as to provide a particular thermal crown across the upper work rolls 104 and/or the lower work rolls 106 without using multiple zone control.

The controller 350 may use any number of variables or inputs to the thermal control system 330 to adjust the thermal crown or camber of the upper work rolls 104 and/or the lower work rolls 106. The specific adjustments may be based on a particular thermal model, level of acceptable tolerance for the finished metal sheet or plate 102, characteristics of the rolling mill 300 and/or whether the rolling mill 300 is being operated during startup, a transition period, or steady state processing. The controller 350 may alter the amount of cooling and/or heating that can alter the temperature and thermal crown of the upper work rolls 104 and/or the lower work rolls 106 by adjusting the duty cycle, pulse width modulation, and/or spray pattern of the heatant spray nozzles 316, the heatant side spray nozzles 324, and/or the coolant spray nozzles 336. In some examples, the controller 350 may adjust the flow rate and/or system pressure of the coolant or heatant to achieve similar results. The controller 350 may also control and/or send information to any bending and tilting control mechanisms of the upper work rolls 104 and/or the lower work rolls 106. In certain examples, the controller 350 may control and/or send information to any bending and tilting control mechanisms of the upper backup rolls 105 and/or the lower backup rolls 107 in addition or substitution to any bending and tilting control mechanisms of the upper work rolls 104 and/or the lower work rolls 106.

Figure 5:
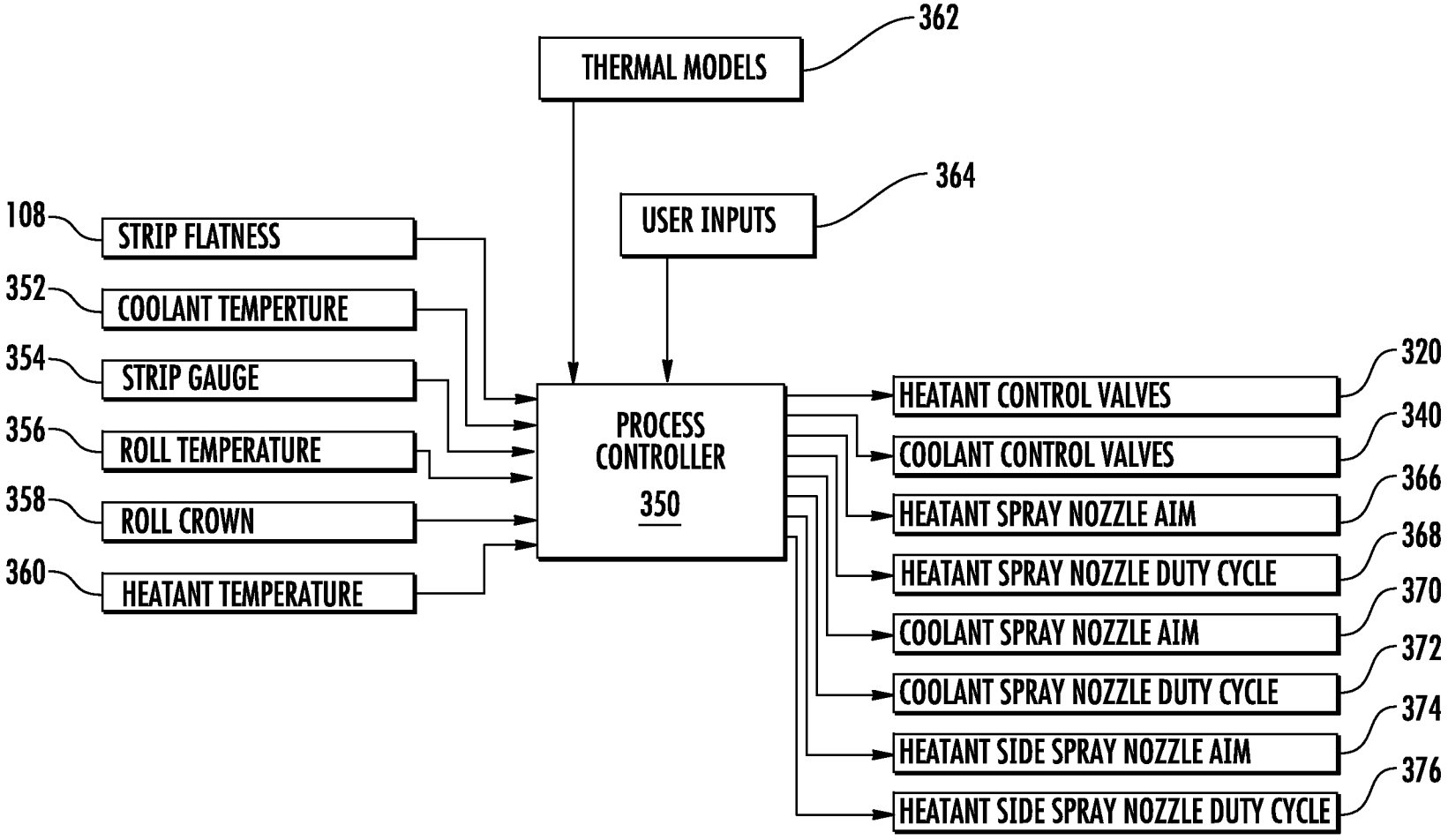
FIG. 5 is a schematic illustration of an optional control system for a rolling mill thermal management system.

FIG. 5 is a schematic illustration of an exemplary control system to be used with a thermal control system, such as thermal control system 330 discussed above. In the example depicted in FIG. 4, the thermal control system 330 can include heatant control valves, coolant control valves, a controller 350, a coolant temperature sensor 352, gauge sensors 354, roll temperature sensors 356, roll crown sensors 358, and heatant temperature sensor 360.

The controller 350 may read in process values for one or more of: i) heatant temperature from the heatant temperature sensor 360; ii) coolant temperature from the coolant temperature sensor 352; iii) work roll temperature from the roll temperature sensors 356; iv) roll crown from the roll crown sensors 358; v) metal sheet or plate 102 flatness from the flatness measurement roll 108; and vi) metal sheet or plate gauge from the gauge sensors 354. Any one or a combination of these measurements may then be input into the controller 350 with thermal models 362 and/or user inputs 364 (e.g., desired flatness tolerances, machine feed rate, material, or other user inputs). These inputs of measurements, user inputs, thermal models, and/or control strategies may then cause the controller 350 to send output signals to control the overall process parameters and rolling mill 300 operating conditions.

For example, the controller 350 may adjust the operation of the heatant control valves 320 and/or the coolant control valves 340 to alter the flow rate and/or system pressure. The controller 350 may also adjust the heatant spray nozzle aim 366, the heatant spray nozzle duty cycle 368, the coolant spray nozzle aim 370, the coolant spray nozzle duty cycle 372, the heatant side spray nozzle aim 374, and/or the heatant side spray nozzle duty cycle 376. The control of the above variables, while by no means an exclusive or exhaustive list, can allow the controller 350 to alter the thermal crown of the upper work rolls 104 and/or the lower work rolls 106. The controller 350 may also alter the spray pattern by adjusting nozzle geometry, varying the above parameters, or by turning individual nozzles on or off. For example, the controller 350 may initiate flow to the heatant spray nozzles 316 during startup procedures to pre-heat the upper work roll 104 and/or the lower work roll 106 to develop a thermal crown across the upper work roll 104 and/or the lower work roll 106 before the metal sheet or plate 102 enters the rolling mill 300. As the rolling mill 300 continues to operate, the upper work roll 104 and/or the lower work roll 106 may begin to generate its own heat, and the controller 350 may stop or reduce flow of heatant to the heatant spray nozzles 316 and initiate or increase coolant flow to the coolant spray nozzles 336. If the heating across the faces of the upper work roll 104 and/or the lower work roll 106 becomes uneven, such as when the metal sheet or plate 102 only covers a portion of the face of the upper work roll 104 and/or the lower work roll 106, the controller 350 may initiate heatant flow to the heatant side spray nozzles 324 or a subset of the heatant spray nozzles 316 or the coolant spray nozzles 336 to maintain the proper temperature distribution in the upper work roll 104 and/or the lower work roll 106.

Figure 6:
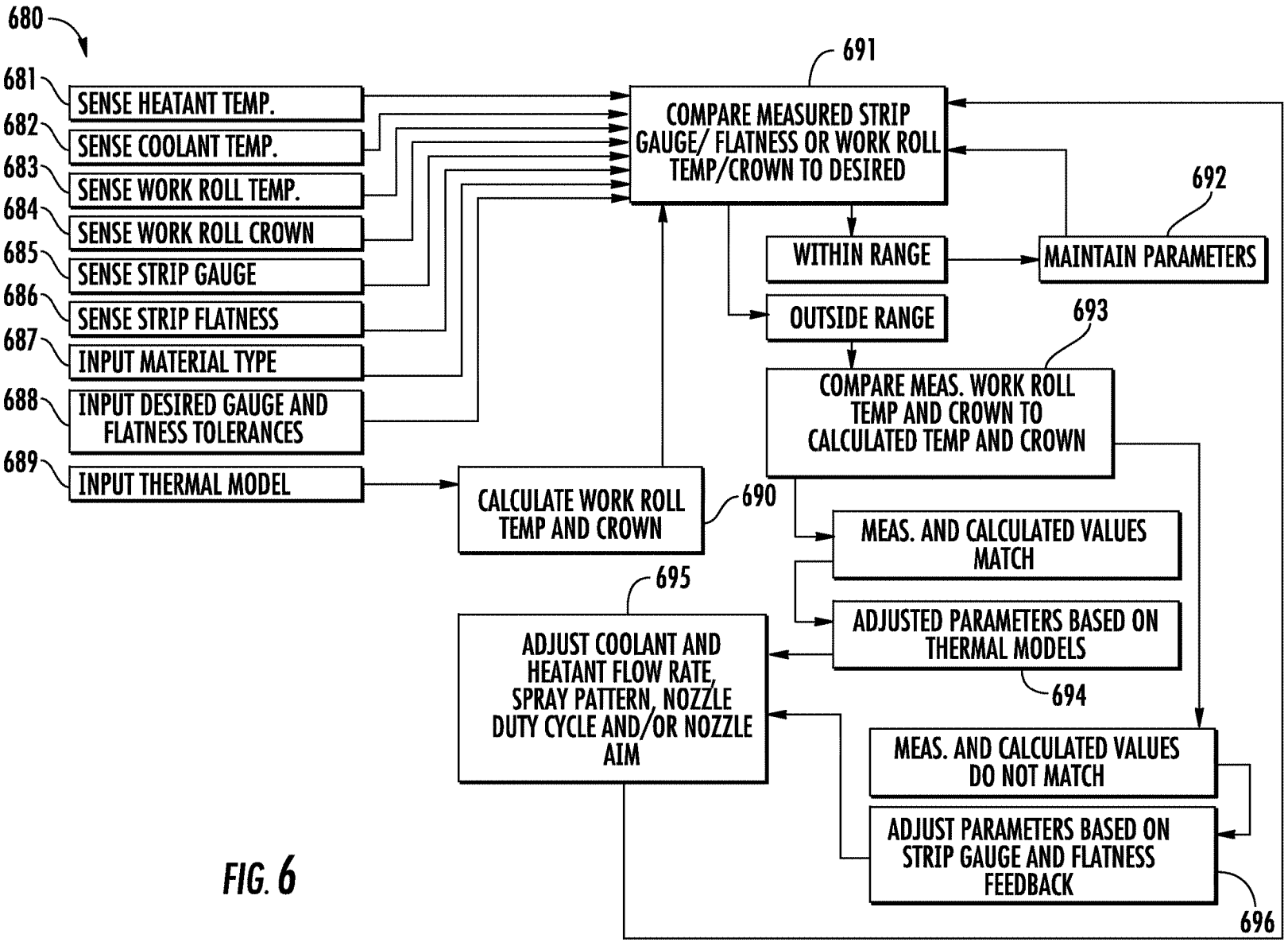
FIG. 6 is an exemplary method for controlling the temperature and thermal crown of a work roll with heating and cooling sprays.

FIG. 6 is a sample control loop 680 for controlling the temperature and thermal crown of a work roll with heating and cooling sprays. The control loop 680 will be described with reference to the example rolling mills shown in FIGS. 1 and 3 and the thermal control systems shown in FIGS. 3-5; however, the control loop is not limited to such examples. Rather, the control loop may be used with any suitable rolling mill or thermal control system according to this disclosure.

The control loop 680 may be used to control a rolling mill (such as rolling mills 100 and/or 300 as described herein) as a single unit, individual work rolls 104, 106, or individual zones of work rolls 104, 106. As an example, a controller 350 may run the example control loop 680 for an entire rolling mill 300, may run separate control loops 680 for each work roll 104, 106, or even may run separate control loops 680 for each zone of a work roll 104, 106. In some examples, not all inputs or outputs of the control loop 680 may be utilized or necessary for controlling the thermal control system 330. Individual inputs and outputs of the control loop 680 may be combined in any number of iterations, or with additional inputs or outputs not listed, to customize the control loop 680 for a particular application or need.

Still referring to FIG. 6, a controller (e.g., the controller 350 of FIGS. 3-5) working in conjunction with a variety of sensors may sense: i) heatant temperature at block 681; ii) coolant temperature at block 682; iii) work roll temperature at block 683; iv) work roll crown at block 684; v) metal sheet or plate 102 gauge at block 685; and/or vi) metal sheet or plate 102 flatness at block 686. These sensed inputs may be combined with user inputs such as, for example, material type at block 687 and desired metal sheet or plate 102 gauge and flatness tolerances at block 688. A user may also input a thermal model at block 689, which may then calculate work roll temperature and crown at block 690. A thermal model, which may be specifically adapted for transient or steady state behavior, may receive information from one or more of blocks 681-688, or may include one or more user inputs (not shown). A thermal model may be based on ambient temperature, material inputs, the upper work roll 104 and/or the lower work roll 106 contact pressure with the metal sheet or plate 102, metal sheet or plate 102 gauge reduction rate, upper backup roll 105 and/or lower backup roll 107 contact pressure, rolling mill 100, 300 run time, or other inputs or measurements. Thermal models may be used to calculate metal sheet or plate 102 flatness and gauge based on any number of inputs or measurements of the overall rolling mill 100, 300.

One or more of the inputs or measurements of blocks 681-690 may then be fed into decision block 691. At decision block 691, a controller 350 or other mechanism may compare measured metal sheet or plate 102 gauge and flatness to desired metal sheet or plate 102 gauge and flatness. The decision block 691 also may compare measured work roll parameters, such as temperature or thermal crown, to desired work roll parameters.

Still referring to FIG. 6, if the measured parameters of decision block 691 fall within the desired ranges, then the control loop will maintain the set points of the parameters at block 692. If, however, the measured parameters of decision block 691 are outside the desired ranges, then the controller 350, at block 693, compares measured process values to any appropriate calculated process values as determined by a thermal model at block 690. If the measured and calculated process values match, the controller 350 can adjust any available process parameters based on the input thermal models at block 694. The use of thermal models at block 694 may allow the controller 350 to adjust process parameters at block 695 in fewer increments or iterations that will yield the desired results because the thermal model may predict the appropriate adjustments. However, if the measured and calculated process parameters do not match, the controller may still adjust process parameters based on a feedback loop system at block 696. Feedback loop controls can use the inputs of block 681-688 with little or no additional processing to adjust the process parameters at block 695. The feedback loop logic of block 696 may require additional iterations or increments to achieve the desired results, but will provide a backup regulation system if process conditions are such that the thermal model is not accurate or applicable. After adjusting the process parameters at block 695, the control loop 680 returns to decision block 691 to continue monitoring and adjusting the rolling mill 300 and the thermal control system 330 as necessary.

Referring to FIGS. 1-6, the thermal crown applied to the upper work roll 104 and/or the lower work roll 106 may vary over the face of the upper work roll 104 and/or the lower work roll 106, and may vary depending on the process parameters, material of the metal sheet or plate 102, and/or length of operation of the rolling mill 300. For example, certain zones of the working faces of the upper work roll 104 and/or the lower work roll 106 may require different amounts of thermal camber to maintain acceptable flatness and quality of the metal sheet or plate 102. To facilitate dynamic shaping of the upper work roll 104 and/or the lower work roll 106, not only to achieve variable thermal crown or camber, but also to alter or adjust that thermal crown or camber as process conditions or requirements change, the work face heating spray system 110, thermal control system 330, and any associated controllers 350 and control loops 680 may be adapted to control subsets or individual heatant spray nozzles 116, 316, heatant side spray nozzles 324, and/or coolant spray nozzles 336. Control over individual nozzles 116, 316, 324, 336 or subsets of nozzles allows for varying the heatant and coolant sprays 118, 318, 338 at different points across the width of the upper work roll 104 and/or the lower work roll 106, and the resulting variability in the amount of thermal crown applied to the upper work roll 104 and/or the lower work roll 106.

Still referring to FIGS. 1-6, the work face heating spray system 110 and/or thermal control system 330 may include additional heatant control valves 120, 320 and/or coolant control valves 340 that control the flow of heatant or coolant to individual, or subsets of, nozzles 116, 316, 324, 336. By restricting the flow of heatant or coolant to the nozzles 116, 316, 324, 336 (or subsets of the nozzles), the shape and distribution of the heatant sprays 118, 318 and coolant sprays 338 can be adjusted to produce a desired amount of thermal crown at any particular point across the width of the face of the upper work roll 104 and/or the lower work roll 106. In some cases, it may be desirable or necessary to apply heatant or coolant to only the upper work roll 104 or to only the lower work roll 106. Selective control of the heatant spray nozzles 116, 316, the heatant side spray nozzles 324, and/or the coolant spray nozzles 336, either through direct nozzle control or the use of heatant control valves 320 and/or coolant control valves 340, can allow heatant or coolant to be delivered only to the appropriate work roll 104, 106 or portions of the work rolls 104, 106. Similarly, in some examples, it may be desirable for the upper work roll 104 and the lower work roll 106 to have thermal crowns that are complimentary, offset, or otherwise different from one another. In such examples, control of subsets or individual nozzles 116, 316, 324, 336 can allow the upper work roll 104 and the lower work roll 106 to receive individualized heatant and coolant sprays 118, 318, 338 so that the thermal crowns of the upper work roll 104 and/or the lower work roll 106 may be independently controlled and varied.

Additional methods of controlling the distribution of heatant sprays 118, 318 and coolant sprays 338 may be possible. For example, each heatant spray nozzle 116, 316, heatant side spray nozzle 324, and/or coolant spray nozzle 336 may be a variable nozzle that can be used to control the flow of heatant or coolant or the shape, distribution, and/or intensity of the heatant spray 118, 318 or coolant spray 338. In such examples, the variable nozzles may restrict or increase flow, or adjust nozzle aim, spray pattern, spray intensity, or duty cycle to provide a desired shape and quality of heatant spray 118, 318 or coolant spray 338 to the upper work roll 104 and/or the lower work roll 106. Similarly, variable valves 120, 320, 340 may alter or adjust the flow of heatant or coolant to the nozzles 116, 316, 324, 336 individually or for a subset of nozzles 116, 316, 324, 336 to provide dynamic shaping of the upper work roll 104 and/or the lower work roll 106. Still other methods of varying the flow rate, pressure, or levels of heatant and coolant to the nozzles 116, 316, 324, 336 or subset of nozzles may be possible. As described above, control over individual nozzles 116, 316, 324, 336 or subsets of nozzles 116, 316, 324, 336 may be desirable to provide differential application of heatant or coolant sprays 118, 318, 338 to different zones across the width of the upper work roll 104 and/or the lower work roll 106.

Figure 7:
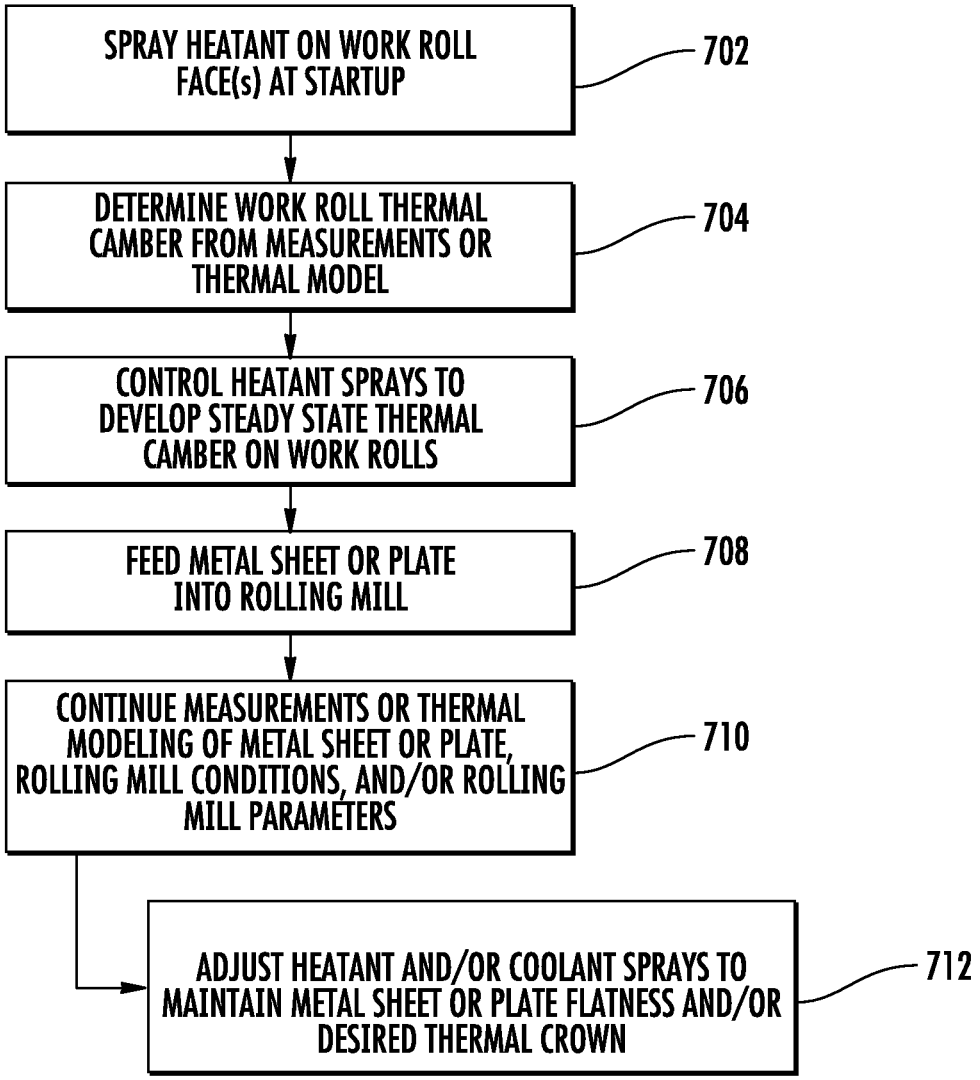
FIG. 7 is an exemplary method for controlling rolling mill thermal camber.

FIG. 7 is an exemplary method for controlling thermal camber of a rolling mill, such as rolling mill 100 or 300 as described above in FIGS. 1-4. During startup or changes in rolling processes and/or the material being rolled, a rolling mill 100 or 300 may have a transient stage of operation before the upper work roll 104 and/or the lower work roll 106 achieves steady state temperature and resulting thermal crown. In some examples, heatant sprays 118, 318 may be sprayed on the upper work roll 104 and/or the lower work roll 106 during start up as shown at block 702, which can prevent generation of scrap material that may require further processing or that may be unusable. The heatant sprays 118, 318 may be applied to the upper work roll 104 and/or the lower work roll 106 through the use of one or more heatant spray nozzles 116, 316, which can further include the use of heatant side spray nozzles 324. In some examples, the heatant sprays 118, 318 may be configured to spray a majority of the face of the upper work roll 104 and/or the lower work roll 106. For example, the heatant sprays 118, 318 may be configured to spray approximately fifty percent or more of the face of the upper work roll 104, approximately fifty percent or more of the face of the lower work roll 106, or approximately fifty percent or more of the face of each of the upper work roll 104 and the lower work roll 106. In another example, the heatant sprays 118, 318 may be configured to spray substantially across the face of the upper work roll 104 and/or the lower work roll 106. For example, the heatant sprays 118, 318 may be configured to spray across approximately ninety percent or more of the face of the upper work roll 104, approximately ninety percent or more of the face lower work roll 106, or approximately ninety percent or more of the face of each of the upper work roll 104 and the lower work roll 106. In still another example, the heatant sprays 118, 318 may be configured to spray across a portion of the upper work roll 104 and/or the lower work roll 106 that contacts the metal sheet or plate 102 (e.g., any percent of the upper work roll 104 or the lower work roll 106 that contacts the metal sheet or plate 102).

In some examples, as the heatant sprays 118, 318 warm the upper work roll 104 and/or the lower work roll 106 during startup, the thermal camber of the upper work roll 104 and/or the lower work roll 106 may be measured or determined through the use of a thermal model at block 704. Using information obtained using the thermal model or obtained via direct measurement, the heatant sprays 118, 318 may be controlled to achieve a steady state thermal crown on the upper work roll 104 and/or the lower work roll 106 at block 706. In some examples, any number of control methods or techniques may be used to influence the development of a steady state thermal crown in the upper work roll 104 and/or the lower work roll 106. In some cases, the heatant spray nozzles 116, 316 may be controlled individually. Heatant control valves 120, 320 may be used to control the flow of heatant to individual heatant spray nozzles 116, 316 and/or heatant side spray nozzles 324. In some cases, the heatant spray nozzles 116, 316 and/or the heatant side spray nozzles 324 may be variable nozzles. Variable nozzles may control the spraying of the heatant by altering flow rate, nozzle aim, spray pattern, spray intensity, and nozzle duty cycle. In certain examples, adjustments to the heatant sprays 118, 318 may be made in response to the output of a sensor, such as a metal sheet or plate flatness sensor, a work roll temperature sensor, a work roll camber sensor, a metal sheet or plate gauge sensor, a heatant temperature sensor, and/or a coolant temperature sensor. After the faces of the upper work roll 104 and/or the lower work roll 106 have achieved a steady state thermal crown, the metal sheet or plate 102 may be fed into the rolling mill 100, 300 for processing.

Still referring to FIG. 7, once the metal sheet or plate 102 has begun processing in the rolling mill 100, 300 at block 708, measuring the thermal crown of the upper work roll 104 and/or the lower work roll 106, monitoring of thermal models, or monitoring of any of the above described sensors may continue. In some cases, the heatant sprays 118, 318 may be used with optional coolant sprays 338 to maintain and/or adjust the temperatures of the upper work roll 104 and/or the lower work roll 106 to maintain the desired thermal crown during processing at block 712. The coolant sprays 338 may be controlled using variable nozzles or coolant control valves 340 similarly to the heatant sprays 118, 318 noted above.

Figure 8:
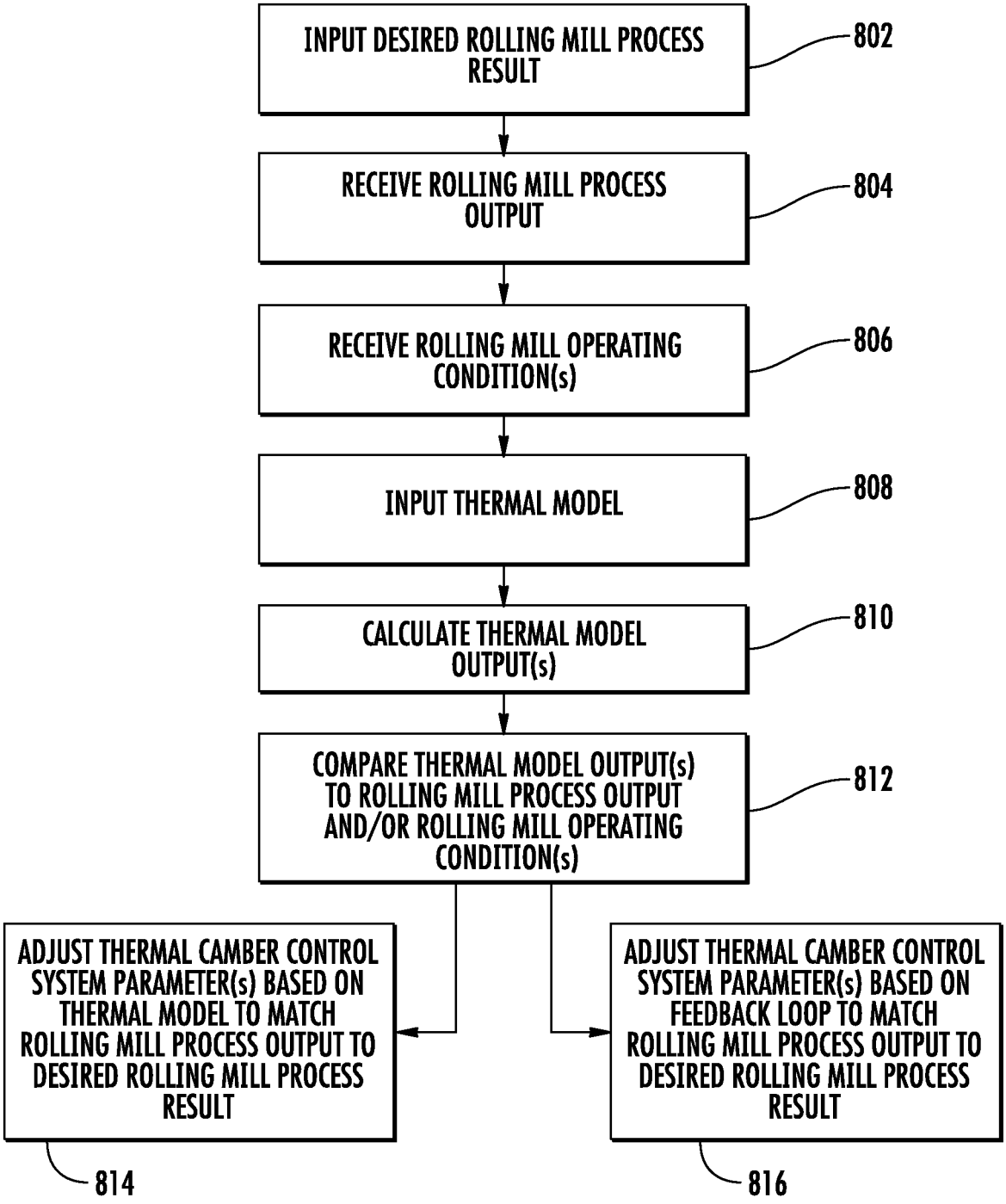
FIG. 8 is an exemplary method for controlling a rolling mill with a thermal camber control system.

FIG. 8 is a method for controlling a rolling mill 100, 300 with a thermal control system 330. At block 802, a user may input one or more desired rolling mill process results, such as the desired metal sheet or plate 102 gauge, the desired metal or plate 102 gauge tolerance, desired metal sheet or plate 102 flatness, and/or desired metal sheet or plate 102 flatness tolerance into a controller 350.

At block 804, the controller 350 may receive rolling mill process outputs. In some cases, the rolling mill process outputs may include, but are not limited to, metal sheet or plate 102 gauge and/or metal sheet or plate 102 flatness.

At block 806, the controller 350 may receive rolling mill operating conditions such as, for example, heatant temperature, coolant temperature, the temperature of the upper work roll 104 and/or the lower work roll 106, and/or information on the dynamic or static camber of the upper work roll 104 and/or the lower work roll 106.

At block 808, a thermal model, which may be specifically adapted for transient or steady state behavior, and may predict, among other things, rolling mill 100, 300 conditions, the camber or shape of the upper work roll 104 and/or the lower work roll 106, or the gauge or flatness of the metal sheet or plate 102, can be input into the controller 350.

At block 810, the controller 350 can then use the thermal model, along with inputs from any applicable sensors as described above, to calculate one or more outputs. Thermal model outputs may include, but are not limited to, gauge or flatness of the metal sheet or plate 102, operating conditions of the rolling mill 100, 300, and/or the temperature, thermal camber, or overall camber of the upper work roll 104 and/or the lower work roll 106.

Still referring to FIG. 8, at block 812, the controller 350 may compare one or more of the thermal model outputs to the rolling mill process outputs of block 804 and/or the rolling mill operating conditions of block 806. If the thermal model outputs of block 810 are in relative agreement with, or sufficiently similar to, the rolling mill process outputs and/or the rolling mill operating conditions, the thermal model input at block 808 may be valid and can be used for predictive adjustments to the system. For example, at block 814, the controller 350 may then adjust the parameters of the thermal control system 330 based on the thermal model to match the rolling mill process output of block 804 with the desired rolling mill process result of block 802.

Returning to block 812, if however, the thermal model outputs of block 810 are not in relative agreement with, or sufficiently similar to, the rolling mill process outputs and/or the rolling mill operating conditions, then the thermal model input at block 808 may not have predictive value under the current operating conditions of the rolling mill 100, 300. In such examples, the controller 350 may then adjust the parameters of the thermal control system 330 based upon a feedback loop at block 816 to match the rolling mill process output of block 804 to the desired rolling mill process result of block 802. In certain cases, the thermal control system 330 parameters may include, but are not limited to, heatant flow rate, coolant flow rate, heatant spray pattern, coolant spray pattern, heatant spray nozzle duty cycle, coolant spray nozzle duty cycle, heatant spray nozzle pattern, coolant spray nozzle pattern, heatant spray nozzle aim, coolant spray nozzle aim, and/or any other variables of the thermal control system 330 that may be used to influence or adjust the amount of thermal camber on the upper work roll 104 and/or the lower work roll 106.

The described methods of FIGS. 7 and 8 may include only a partial set of described steps, additional steps, or different arrangements or orders of steps than those described above.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

That which is claimed is:

1. A metal rolling system comprising:

an upper work roll having an upper work roll width and an upper work roll face;

a lower work roll having a lower work roll width and a lower work roll face;

a work face heating spray device comprising a heating spray nozzle;

a heated liquid reservoir containing a heatant, the heated liquid reservoir couplable to the work face heating spray device to provide the heatant to the work face heating spray device, and wherein the work face heating spray device is configured to receive the heatant and the heating spray nozzle is positionable proximate to at least one of the upper work roll or the lower work roll to apply the heatant to at least one of the upper work roll face or the lower work roll face; and a control system comprising a controller and at least one sensor, wherein the at least one sensor directly measures at least one of the upper work roll or the lower work roll as sensor data, wherein the at least one sensor comprises at least one of a work roll temperature sensor or a work roll camber sensor, and wherein the controller is configured to pre-heat at least one of the upper work roll or the lower work roll by controlling the heatant applied to at least one of the upper work roll face or the lower work roll face prior to processing a metal substrate with the metal rolling system and at least partially based on the sensor data.

2. The metal rolling system of claim 1, wherein the work face heating spray device comprises a plurality of heating spray nozzles.

3. The metal rolling system of claim 2, wherein the plurality of heating spray nozzles are individually controllable.

4. The metal rolling system of claim 1, further comprising heated edge sprays.

5. The metal rolling system of claim 1, further comprising a heatant control valve.

6. The metal rolling system of claim 1, wherein the heating spray nozzle is a variable nozzle.

7. The metal rolling system of claim 6, wherein the variable nozzle is configured to control the application of the heatant by adjusting a parameter associated with the heating spray nozzle, the parameter including a flow rate, nozzle aim, spray pattern, spray intensity, or a duty cycle.

8. The metal rolling system of claim 1, further comprising a work face cooling spray device, the work face cooling spray device comprising:

a cooling spray nozzle; and a cooling liquid reservoir containing a coolant, the cooling liquid reservoir couplable to the cooling spray nozzle to provide the coolant to the cooling spray nozzle, and wherein the cooling spray nozzle is positionable proximate to at least one of the upper work roll or the lower work roll and the cooling spray nozzle is configured to receive the coolant and apply the coolant to at least one of the upper work roll face or the lower work roll face.

9. The metal rolling system of claim 8, further comprising a coolant control valve.

10. The metal rolling system of claim 1, wherein the work face heating spray device is positioned proximate to at least one of the upper work roll or the lower work roll to apply the heatant to a majority of at least one of the upper work roll width or the lower work roll width.

11. The metal rolling system of claim 1, wherein the work face heating spray device applies the heatant substantially across at least one of the upper work roll width and the lower work roll width.

12. The metal rolling system of claim 1, wherein the work face heating spray device applies the heatant to a portion of the upper work roll face or the lower work roll face that contacts a metal work piece.

13. A rolling mill thermal camber control system comprising:

a plurality of heating spray nozzles;

a heatant reservoir containing a heatant; and a control system comprising a controller and at least one sensor, wherein the at least one sensor directly measures at least one work roll of the rolling mill as sensor data, and wherein the at least one sensor comprises at least one of a work roll temperature sensor or a work roll camber sensor, wherein each heating spray nozzle of the plurality of heating spray nozzles is individually controllable, wherein the plurality of heating spray nozzles are positionable proximate to the at least one work roll of a rolling mill and configured to apply the heatant to the at least one work roll of the rolling mill, and wherein the controller is configured to pre-heat the at least one work roll by controlling the heatant applied to a work roll face of the work roll face prior to processing a metal substrate and at least partially based on the sensor data.

14. A method for controlling rolling mill thermal camber, the method comprising:

providing a work face heating spray device comprising a heating spray nozzle configured to deliver a heated liquid to a rolling mill work roll; and spraying, via the heating spray nozzle, the heated liquid onto a face of the rolling mill work roll during rolling mill start-up;

controlling the work face heating spray device to develop a steady state thermal camber on the face of the rolling mill work roll;

feeding a metal work piece into the rolling mill; and controlling the work face heating spray in response to an output of at least one sensor, wherein the at least one sensor directly measures the rolling mill work roll as sensor data, wherein the at least one sensor comprises at least one of a work roll temperature sensor or a work roll camber sensor, and controlling the work face heating spray comprises pre-heating the rolling mill work roll by applying the heated liquid to the roll face of the rolling mill work roll prior to processing a metal substrate with the metal rolling system and at least partially based on the sensor data.

15. The method of claim 14, wherein the work face heating spray device comprises a plurality of heating spray nozzles.

16. The method of claim 15, further comprising individually controlling each of the plurality of heating spray nozzles.

17. The method of claim 14, further comprising providing heated edge sprays.

18. The method of claim 14, further comprising controlling the delivery of the heated liquid with a heated liquid control valve.

19. The method of claim 14, wherein the heating spray nozzle is a variable nozzle.

20. The method of claim 19, wherein the variable nozzle controls the spraying of the heated liquid by adjusting a parameter associated with the heating spray nozzle, the parameter including a flow rate, nozzle aim, spray pattern, spray intensity, or duty cycle.

21. The method of claim 14, further comprising cooling the rolling mill work roll face with a work face cooling spray device.

22. The method of claim 21, further comprising controlling the work face cooling spray device with a coolant control valve.

23. The method of claim 14, wherein spraying the heated liquid on the face of the rolling mill work roll comprises spraying the heated liquid across a majority of the face of the rolling mill work roll.

24. The method of claim 14, wherein spraying the heated liquid on the face of the rolling mill work roll comprises spraying the heated liquid substantially across the face of the rolling mill work roll.

25. The method of claim 14, wherein spraying the heated liquid onto the face of the rolling mill work roll comprises spraying the heated liquid onto a portion of the face of the rolling mill work roll that contacts the metal work piece.

26. The method of claim 14, further comprising:

inputting at least one desired rolling mill process result;

receiving at least one rolling mill process output;

comparing the at least one rolling mill process output with the at least one desired rolling mill process result; and adjusting at least one rolling mill thermal camber control system parameter to match the at least one rolling mill process output with the at least one desired rolling mill process result.

27. The method of claim 26, wherein the at least one desired rolling mill process result is selected from the group consisting of desired metal gauge, desired metal gauge tolerance, desired metal flatness, and desired metal flatness tolerance.

28. The method of claim 26, wherein the at least one rolling mill process output is selected from the group consisting of metal sheet or plate gauge and metal sheet or plate flatness.

29. The method of claim 26, wherein the at least one rolling mill thermal camber control system parameter is selected from the group consisting of heatant flow rate, coolant flow rate, heatant spray pattern, coolant spray pattern, heatant spray nozzle duty cycle, coolant spray nozzle duty cycle, heatant spray nozzle pattern, coolant spray nozzle pattern, heatant spray nozzle aim, and coolant spray nozzle aim.

30. The method of claim 26, further comprising receiving at least one rolling mill operating condition.

31. The method of claim 30, wherein the at least one rolling mill operating condition is selected from the group consisting of heatant temperature, coolant temperature, work roll temperature, and work roll camber.

32. The method of claim 30, further comprising:

inputting a thermal model;

calculating thermal model outputs from the thermal model;

comparing the thermal model outputs with a parameter selected from the group consisting of the at least one rolling mill process output and the at least one rolling mill operating condition; and adjusting the at least one rolling mill thermal camber control system parameter based on the thermal model, wherein the thermal model outputs agree with the parameter selected from the group consisting of the at least one rolling mill process output and the at least one rolling mill operating condition.

33. The method of claim 26, wherein adjusting the at least one rolling mill thermal camber control system parameter is based on feedback loop controls.

* * * * *